US009605528B2

(12) United States Patent
Rodney

(10) Patent No.: US 9,605,528 B2
(45) Date of Patent: Mar. 28, 2017

(54) DISTRIBUTED SENSING WITH A MULTI-PHASE DRILLING DEVICE

(71) Applicant: Halliburton Energy Services, Inc., Houston, TX (US)

(72) Inventor: Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 266 days.

(21) Appl. No.: 14/389,797

(22) PCT Filed: Mar. 13, 2014

(86) PCT No.: PCT/US2014/025680
§ 371 (c)(1),
(2) Date: Oct. 1, 2014

(87) PCT Pub. No.: WO2014/160035
PCT Pub. Date: Oct. 2, 2014

(65) Prior Publication Data

US 2016/0258268 A1 Sep. 8, 2016

Related U.S. Application Data

(60) Provisional application No. 61/804,810, filed on Mar. 25, 2013.

(51) Int. Cl.
*E21B 47/00* (2012.01)
*E21B 7/00* (2006.01)
(Continued)

(52) U.S. Cl.
CPC ..... *E21B 47/00* (2013.01); *E21B 7/00* (2013.01); *E21B 47/04* (2013.01); *E21B 47/10* (2013.01);
(Continued)

(58) Field of Classification Search
CPC ..... E21B 47/00; E21B 47/10; E21B 47/14; E21B 47/122; E21B 49/003; E21B 7/04; E21B 4/18; E21B 47/01
See application file for complete search history.

(56) References Cited

U.S. PATENT DOCUMENTS 4,325,438 A 4/1982 Zuvela
4,463,814 A 8/1984 Horstmeyer et al.
(Continued)

FOREIGN PATENT DOCUMENTS

EP 0951748 B1 11/2007
WO 98/30481 A2 7/1998
(Continued)

OTHER PUBLICATIONS

International Preliminary Report on Patentability issued in related PCT Application No. PCT/US2014/025680 mailed Oct. 8, 2015 (10 pages).
(Continued)

*Primary Examiner* — Brad Harcourt
(74) *Attorney, Agent, or Firm* — Benjamin Fite; Baker Botts L.L.P.

(57) ABSTRACT

An example method for distributed sensing in a subterranean formation may include drilling to a first depth in the subterranean formation using a drilling device and detaching a first phase of the drilling device at the first depth. The first phase may include a first coil of line and a first sensor. The drilling assembly may drill to a second depth and decouple a second phase of the drilling device, with the second phase including a second coil of line and a second sensor. Measurements may be generated at the first and second depths using the first and second sensors, respectively.

20 Claims, 5 Drawing Sheets

(51) Int. Cl.

| | |
|---|---|
| ***E21B 47/04*** | (2012.01) |
| ***E21B 47/10*** | (2012.01) |
| ***E21B 47/12*** | (2012.01) |
| ***E21B 47/14*** | (2006.01) |
| ***E21B 49/00*** | (2006.01) |
| *E21B 7/04* | (2006.01) |

(52) U.S. Cl.
CPC ..... *E21B 47/122* (2013.01); *E21B 47/14* (2013.01); *E21B 49/003* (2013.01); *E21B 7/04* (2013.01)

(56) References Cited

U.S. PATENT DOCUMENTS

| | | | | |
|---|---|---|---|---|
| 5,828,003 | A | 10/1998 | Thomeer et al. | |
| 6,630,890 | B1 | 10/2003 | Endo et al. | |
| 6,857,486 | B2 | 2/2005 | Chitwood et al. | |
| 7,093,673 | B2 | 8/2006 | Stokka | |
| 7,172,038 | B2 | 2/2007 | Terry et al. | |
| 7,836,977 | B2 | 11/2010 | Head | |
| 8,011,435 | B2 | 9/2011 | Carossino et al. | |
| 2002/0195247 | A1* | 12/2002 | Ciglenec ..... | E21B 7/06 166/250.11 |
| 2006/0042835 | A1 | 3/2006 | Guerrero et al. | |
| 2006/0221768 | A1 | 10/2006 | Hall et al. | |
| 2009/0283258 | A1 | 11/2009 | Poitzsch et al. | |
| 2011/0203846 | A1 | 8/2011 | Degrange et al. | |
| 2013/0043884 | A1 | 2/2013 | Le et al. | |

FOREIGN PATENT DOCUMENTS

| | | | |
|---|---|---|---|
| WO | 02/25317 | A1 | 3/2002 |
| WO | 2010/058033 | A1 | 5/2010 |

OTHER PUBLICATIONS

International Search Report and Written Opinion issued in related PCT Application No. PCT/US2014/025680 mailed Jul. 24, 2014, 14 pages.

Earthwormlike exploratory robots, National Aeronautics and Space Administration Contract No. NAS 7-198, NASA Tech Brief vol. 22, No. 6, Item #138 from JPL New Technology Report NPO-20266.

The Kolibomac Micro Tunnel machine, www.tunnelandgeoconsult.com.

Drilling mechanism of autonomous burrowing robot for lunar subsurface exploration, Kenji Nagaoka et al., (journal not stated).

An agile burrowing robot for underground chemical source location, R. Andrew Russell, Intelligent Robotics Research Centre, Monash University, Clayton, VIC 3800, Australia, Proceedings of Australasian Conference on Robotics and Automation, Dec. 7-9, 2011, Monash University, Melbourne, Australia.

Extended Search Report issued in related European Application No. 14772682.2, mailed Aug. 12, 2016 (8 pages).

* cited by examiner

DISTRIBUTED SENSING WITH A MULTI-PHASE DRILLING DEVICE

CROSS-REFERENCE TO RELATED APPLICATION

The present application claims priority to PCT Patent Application No. PCT/US2014/025680 filed Mar. 13, 2014 and U.S. Provisional Application No. 61/804,810, entitled "Distributed Sensing with a Multi-Phase Drilling Device" and filed on Mar. 25, 2013, both of which are incorporated herein in their entirety for all purposes.

BACKGROUND

During or in anticipation of well drilling operations, it may be necessary to locate subterranean objects, some of which may be at a large distance or depth from the surface. In certain instances, the object may be a wellbore for a well that has lost pressure containments, i.e., is blowing out. In other embodiments, the object may be a hydrocarbon reservoir within a subterranean formation. Deep sensing tools, i.e., tools and sensors with a large range, are useful in locating subterranean objects. Typical deep sensing tools include arrays of wireline sensors or arrays of measurement-while-drilling/logging-while-drilling (MWD/LWD) sensors coupled to a drill string. Wireline sensors require a pre-existing borehole, however, and MWD sensors are confined to devices that construct boreholes.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

Figure 1:
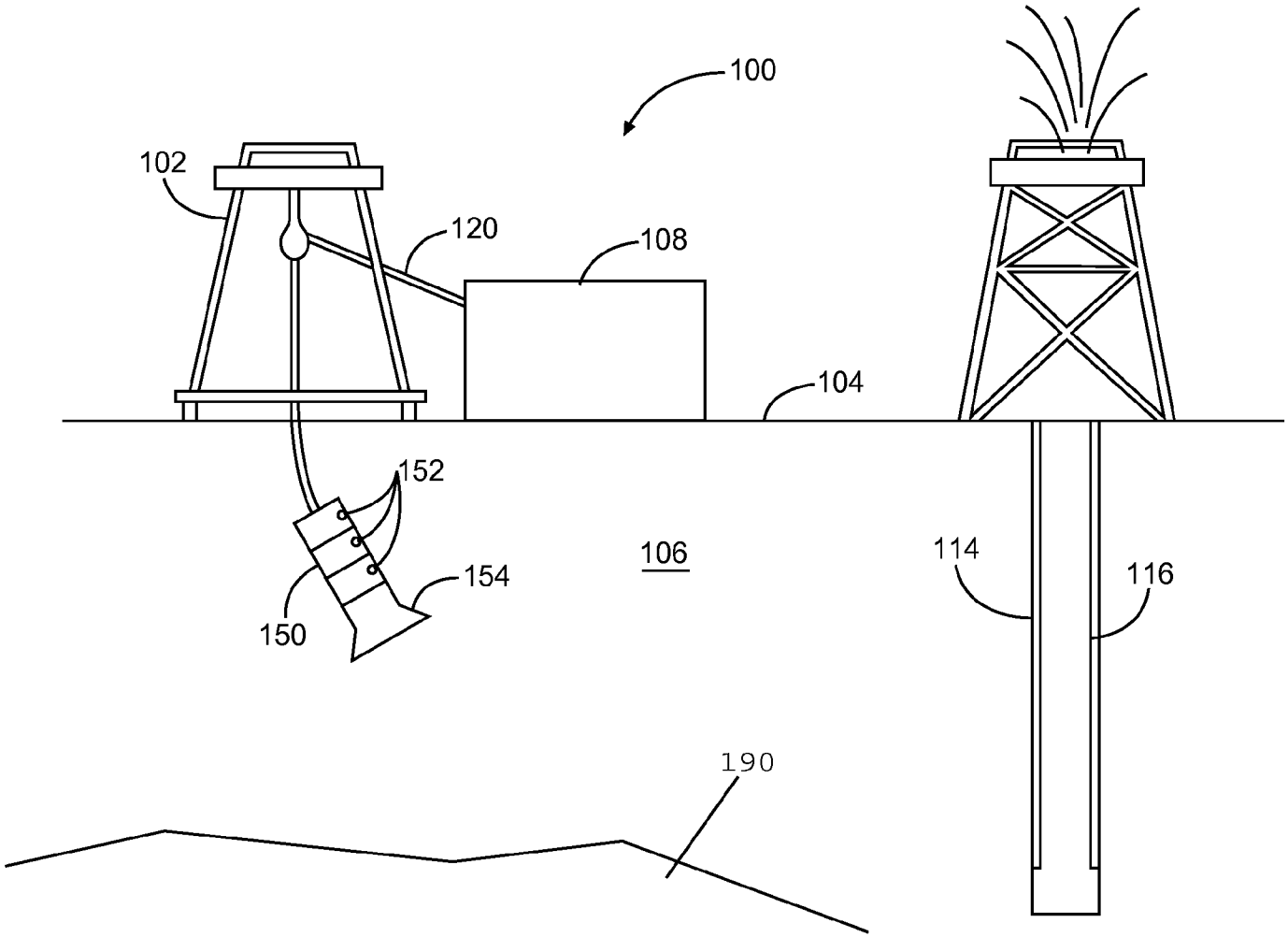
FIG. 1 is a diagram of an example drilling system incorporating a multi-phase drilling device, according to aspects of the present disclosure

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to downhole drilling operations and, more particularly, to distributed sensing with a multi-phase drilling device.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include, but are not limited to, exploratory wells, target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, stimulation wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including LWD and MWD. In LWD, data is typically collected during the drilling process, thereby avoiding any need to remove the drilling assembly to insert a wireline logging tool. LWD consequently allows the driller to make accurate real-time modifications or corrections to optimize performance while minimizing downtime. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces.

The present application describes a multi-phase drilling device that may provide distributed sensing capabilities. The distributed sensing capabilities may be used for deep sensing applications, such as measuring acoustic or electrical properties deep within a formation or locating a well that is blowing out. According to aspects of the present disclosure, a multi-phase drilling device may comprise a device that is only used for exploration or monitoring and neither requires nor creates a borehole. The multi-phase drilling device may, therefore, be used to provide formation information that will be of use in subsequently drilling for hydrocarbons, or locate a well that is blowing out and identify a precise path of intersection to the well without actually drilling to the well.

FIG. 1 is a diagram of an example drilling system 100 incorporating a multi-phase drilling device 150, according to aspects of the present disclosure. The system 100 comprises a rig 102 mounted at the surface 104 of a subterranean formation 106. The rig 102 may support a wireline 120 coupled between the multi-phase drilling device 150 and a surface control unit 108. As used herein, the term wireline may refer to typical wireline, slickline, coiled tubing, or any other type of line that would be appreciated by one of ordinary skill in the art in view of this disclosure. As will be described in detail below, the device 150 may comprise a drill bit 154 coupled to a plurality of detachable phases, at least some of which include separate sensors 152 and coils of wireline.

In the embodiment shown, the surface control unit 108 may anchor the wireline 120, which may spool from at least one coil of wireline within the device 150 as the device moves away from the surface 104. In certain embodiments, the surface control unit 108 may comprise an information handling system (not shown) that is communicably coupled to the device 150 through the wireline 120. Specifically, the wireline 120 may function as a telemetry channel, conveying commands to the device 150 from a surface control unit 108 and transmitting to the surface control unit 108 data from the device 150, such as measurement data from the sensors 152. In addition to the communications channel provided by the wireline 120, the device 150 may receive power from the control unit 108 through the wireline 120, as well as drilling fluids that may function to keep the drill bit 154 cool as it drills within the formation 106. In certain embodiments, the wireline 120 may have at least two conductors arranged coaxially to support simultaneous, bi-directional communications.

The sensors 152 may measure signals that may be used to determine at least one characteristic of an object located within the formation 106. Specifically, the measured signals may be transmitted to an information handling system at the surface control unit 108 that may include software configured to determine the characteristic of the object based, at least in part, on the measured signals. Example objects include zones or rock strata or interest within the formation 106, existing wellbores within the formation 106, etc. Characteristics of an object may comprise its location, relative orientation, etc. In certain embodiments, the characteristic of the object located within the formation 106 may comprise the location of a rock strata 190 within the formation 106, a composition of the rock strata 190, the presence of hydrocarbons within the formation 106 generally and the strata 190 in particular, and the location of a metallic casing 116 within a vertical wellbore 114. Other types and orientation of wellbores are possible, including uncased horizontal wellbores.

In the embodiment shown, the wellbore 114 comprises a "blow-out" in which pressure containment has been lost and fluids from the formation 106 are flowing, uncontrolled, from the wellbore 114 to the surface 104. The sensors 152 of the device 150 may be used to measure and detect the location of the wellbore 114 for the purpose of identifying, for example, where a relief well may intersect the wellbore 114 to redirect the fluid from the wellbore 114 and control the blow-out.

In contrast to a conventional drilling assembly, the use of the drill bit 154 in device 150 may be limited to the movement of the device 150 within the formation 106, not the generation of a borehole to be used at a later time. This may reduce the time and overall expense of the drilling operation. Additionally, when used as a formation evaluation tool, the device can help the operator determine if hydrocarbons are present, and if so where they are without going to the expense and risk of drilling a full borehole which might turn out to be a "dry hole." Moreover, the use of the wireline 120 between the device 150 and the control unit 108 allows for a greater communication bandwidth between the two, such as in a typical wireline tool, without the need for an existing borehole in which to introduce the wireline tool.

Figure 2:
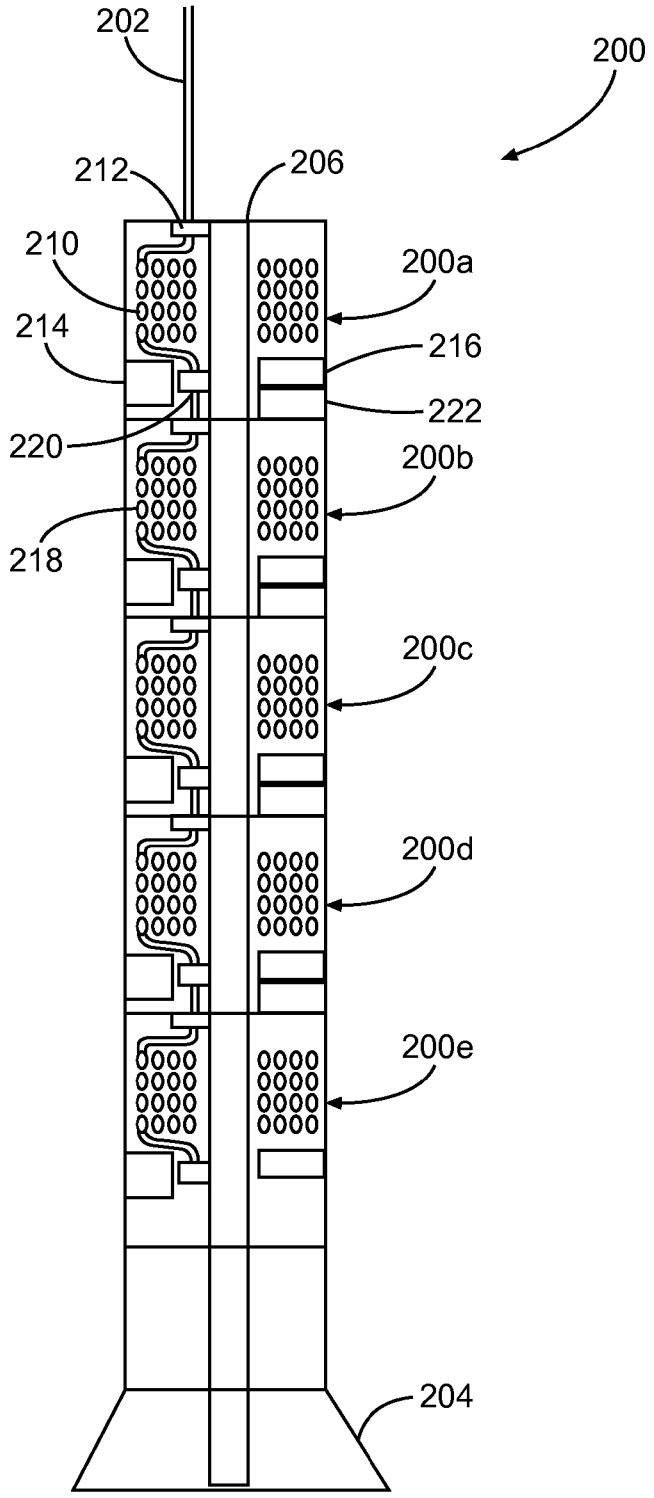
FIG. 2 is diagram of an example multi-phase drilling device according to aspects of the present disclosure.

FIG. 2 is diagram of an example drilling device 200 with multiple detachable phases 200*a*-200*e*, according to aspects of the present disclosure. Each of the detachable phases 200*a*-200*e* may comprise a cylindrical metallic housing that is releasably coupled to at least one adjacent detachable phase upon deployment into a formation. Although drilling device 200 includes five detachable phases 200*a*-200*e*, the number of phases is not limited to five. In certain embodiments, each of the detachable phases 200*a*-200*e* may have releasable latches that may be triggered remotely or automatically. Additionally, each of the detachable phases 200*a*-200*e* may include a central bore, collectively labeled 206, that may allow cuttings from the formation to flow through the drilling device during operation. Notably, rather than forming a defined borehole, where the cuttings from the drill bit 204 are transmitted to the surface for removal, the drilling device 200 may push the cuttings behind the drilling device 200 as it penetrates the formation and may not remove the cuttings.

Detachable phase 200*a* comprises a coil of line 210 disposed within an external housing. The coil of line 210 may comprise a coil of wireline that extends to the surface or is coupled to a separate wireline segment 202 that is anchored at a surface control unit. The coil of line 210 may be paid out of the top of the detachable phase 200*a* through a line sensing assembly 212, embodiments of which are described in detail below. The line sensing assembly 212 may sense how much of the coil of line 210 has been paid out of the detachable phase 200*a* into the formation, which may in turn be used to determine the depth of the device 200 with respect to the surface.

In certain embodiments, the detachable phase 200*a* may comprise at least one control unit 214 and at least one measurement/logging unit 216. The control unit 214 may include a controller or processor and may communicate via line 202 with a surface controller and with other control units within the drilling device 200. In certain embodiments, the control unit 214 may further communicate with the light sensing assembly 212 to determine the length of the coil of line 210 that has been paid out. Likewise, the control unit 214 may be in communication with a releasable latch 222 holding detachable phase 200*a* to detachable phase 200*b*. The control unit 214 may release the latch 222, for example, in response to a command from a surface control unit, or when a pre-determined length of line has been paid out.

In certain embodiments, the control unit 214 may further be in communication with measurement/logging unit 216. The measurement/logging unit 116 may comprise at least one sensor. For example, the measurement/logging unit may include acoustic sensors, such as geophones or hydrophones. Alternatively or in addition, the measurement/logging unit 216 may include electric or magnetic field sensors. Additionally, measurement/logging unit 216 may contain acoustic or electromagnetic transmitters, such solenoids, toroids or electric field antennas and piezoelectric or Terfonal-D stacks. Transmitting acoustic or electromagnetic signals into the formation and receiving and measuring formation responses to and reflections of the transmitted signals be controlled in whole or in part through the control unit 214 and a surface control unit.

Coil of line 210 in detachable phase 200*a* may be coupled to a coil of line 218 in an adjacent detachable phase 200*b* at connector 220. Communication signals, including command signals and telemetry signals, may be transmitted along the line 202, through the coil of line 210, into coil of line 218, and through the rest of the line within the drilling device 200. In certain embodiments, commands may be directed to a particular detachable phase through an addressing scheme.

Notably, as shown in FIG. 2, the detachable phases 200*a*-200*e* may all have similar configurations, with the exception of the bottom-most phase 200*e*, which includes drill bit 204 and may include a drilling motor to drive the drill bit 204, such as a mud motor. In certain embodiments, some or all of the detachable phases 200*a*-200*e* may have different configurations. For example, in certain embodiments, the drilling device 200 may have one primary control unit in one detachable phase, and secondary or slave control units in the other phases. Likewise, some of the detachable phases may include different types of sensors and measurement equipment.

In operation, the drilling device 200 may be deployed into a formation, where it begins to drill. Cuttings from the drill bit 204 may pass through bore 206 and come to rest behind the drilling device 200. As the drilling device 200 moves away from the surface, the coil of line 210 may be paid out of the detachable phase 200*a*. The coil of line 210 may be paid out until a desired location or first depth is reached in a formation, or until the line is at its maximum extension. Upon command from a surface control unit, for example, the detachable phase 200*a* may release or otherwise be disconnected from the rest of the drilling device 200, and detachable phase 100*b* in particular, at the first depth. Drilling may then progress with the remainder of the drilling device 200 while the detachable phase 200*a* remains generally stationary within the formation. In certain embodiments, the detachable portions 200*a*-200*e* may further comprise extendable anchors that can be deployed to keep the corresponding detachable phase stationary after it has been decoupled from the drilling device 200. The extendable anchors may take a variety of configurations, such as arms and blades, and may be extendable using a variety of means, including hydraulic and electronic motors or pumps.

As the drilling device 200 continues to drill within the formation, the coil of line 218 may be paid out of detachable phase 200*b*. The coil of line 218 may be paid out until a second desired location or depth is reached in a formation, or until the line is at its maximum extension. Upon command from a surface control unit, for example, the detachable phase 200*b* may release or otherwise be decoupled from the rest of the drilling device 200, and detachable phase 200*c* in particular, at the second depth. Drilling may then progress with the remainder of the drilling device 200 while the detachable phase 200*b* remains generally stationary within the formation. This process may continue, with the coil of line in each detachable phase being paid out until some or all of the detachable phases are distributed within the formation.

Figure 3:
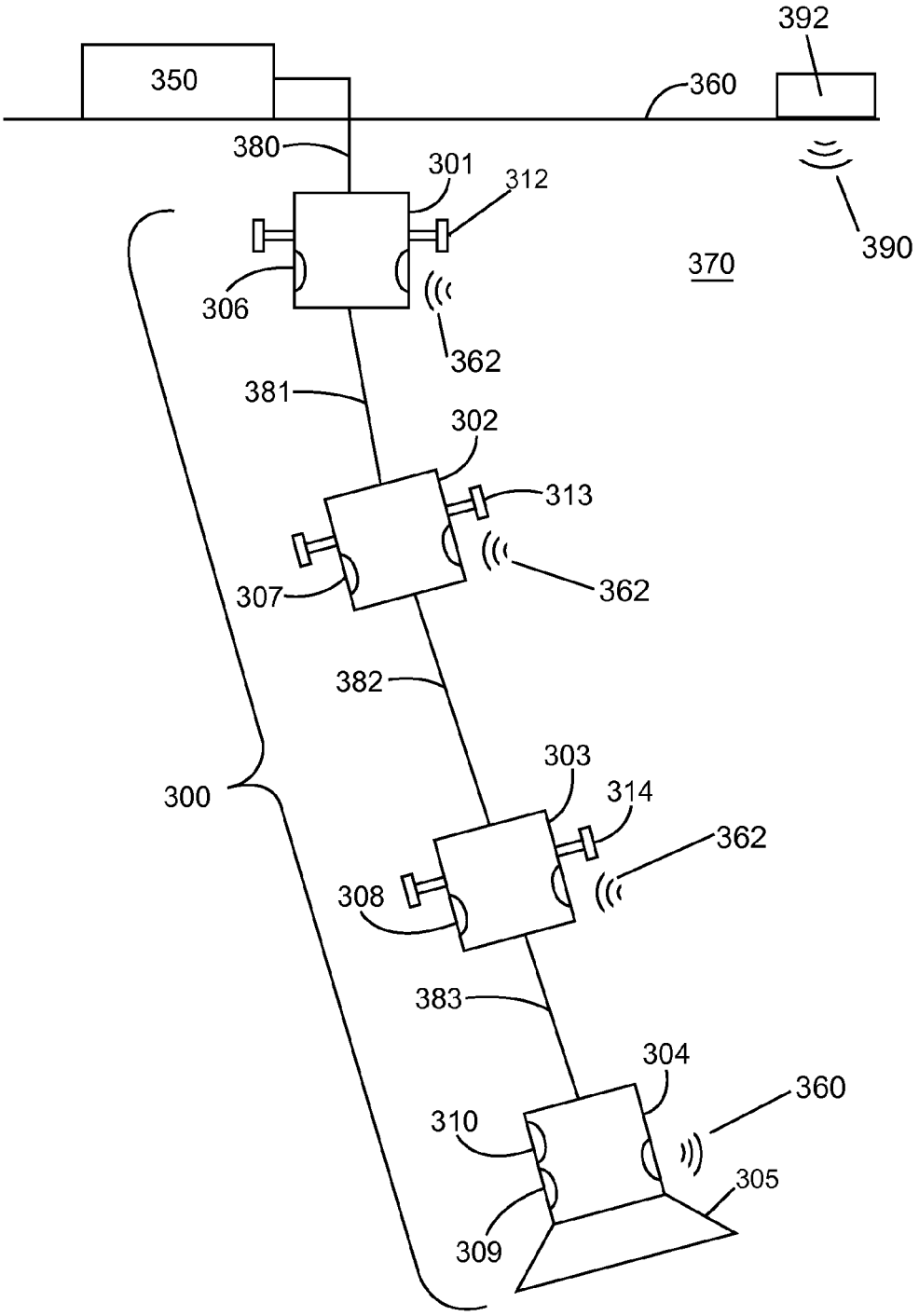
FIG. 3 is a diagram of an example distributed sensing apparatus using a multi-phase drilling device according to aspects of the present disclosure.

FIG. 3 is a diagram of an example multi-phase drilling device 300 deployed in a distributed sensing arrangement according to aspects of the present disclosure. The multi-phase drilling device 300 may comprise detachable phases 301-304, with drill bit 305 incorporated within detachable phase 304. The multi-phase drilling device 300 may be in communication with a control unit 350 at the surface 360 through line 380. Some or all of the detachable phases 301-304 may comprise extendable anchors 312-314, as described above.

Each of the detachable phases 301-304 has been detached from the multi-phase drilling device 300 and is deployed within the formation 370 in a distributed sensing arrangement. Notably, all of the detachable phases do not have to be deployed for the multi-phase drilling device 300 to be deployed in a distributed sensing arrangement. In certain embodiments, the multi-phase drilling device 300 may be deployed in a distributed sensing arrangement if at least one detachable phase that is detached from the multi-phase drilling device 300 is within the formation 370.

In certain embodiments, the location of each of the detachable phases 301-304 may be tracked as the drilling device 300 penetrates the formation 370, or may be determined after the fact. For example, a survey assembly 310 may be included in at least one of the detachable phases

301-304. The survey assembly 310 may include a three-axis accelerometer and a two or three-axis magnetometer; a three-axis accelerometer and a two or three-axis gyroscope unit; or a three-axis accelerometer, a two or three-axis magnetometer, and a two or three-axis gyroscope unit. As would be appreciated by one of ordinary skill in view of this disclosure, the location of a detachable phase can be determined given periodic measurements from a three-axis accelerometer, a two or three axis magnetometer (or a two-axis gyro measurement) and the depth at each location where the periodic measurements were made. The depth may be defined as the distance along the trajectory that has been taken by the drilling device, which may be defined by the total length of line that has been paid out at a given measurement point plus the length of the detachable phases that have been detached at the time of the measurement. Magnetometers may not be preferable because large currents may be present in the detachable phases, however, magnetic interference can be minimized with judicial care for the placement of the wires carrying the currents and of the magnetometers. Additionally, if magnetometers are used, it may be preferable that no magnetic materials be used in the detachable phases, or if magnetic materials are used, that they be separated from the magnetometers so that any magnetic interference is either negligible or can be compensated for.

Detachable phases 301-304 may each comprise at least one of a transmitter and a sensor, illustrated by elements 306-309, respectively. The transmitters and sensors 306-309 may comprise separate elements devoted to either transmitting signals or receiving signals, or combined elements, such as antennas, that can act as a transmitter and a receiver, which may generally be referred to as a sensor herein. Example transmitters may include acoustic transmitters, electromagnetic transmitters, magnetic field sources, or electric field sources. Example sensors include geophones, hydrophones, electric or magnetic field sensors, and antenna.

In certain embodiments, after at least one detachable phase has been separated, an acoustic or electromagnetic signal may be transmitted into the formation 370 by one of the detachable phases and received at the other detachable phases, whether or not they are connected to the drilling device 300. In the embodiment shown, the detachable phase 304 has been configured to transmit an acoustic or electromagnetic signal 360 into the formation 370, and the detachable phases 301-303 have been configured to measure the formation responses to or reflections of transmitted acoustic or electromagnetic signal 360, as illustrated by waves 362. In the case of an acoustic signal, the sensors 306-308 of the respective detachable phases 301-303 may comprise geophones or acoustic sensors to measure the signals 362, and the transmitter 309 of the detachable phase 304 may comprise a piezoelectric or Terfonal-D stack to transmit the signal 360. In the case of an electromagnetic signal the sensors 306-308 of the respective detachable phases 301-303 may comprise magnetometers or electric field sensors to measure the signals 362, and the transmitter 309 of the detachable phase 304 may comprise solenoids, toroids, or electric field antennas to transmit the signal 360. The measured signals may be transmitted either in digital or analog form to the control unit 350 where they may processed.

One example method for using the drilling device 300 may comprise deploying the detachable phases 301-304 at measured depths d1, d2, d3, and d4, respectively. The location of each of the detachable phases 301-304 may be known using methods described above. The drilling device 300 may then take measurements by transmitting an electromagnetic or acoustic signal 360 from at least one of the detachable phases and measuring a formation response to or reflection of the transmitted electromagnetic or acoustic signal 362 with at least one of the other detachable phases, or with all of the other detachable phases, as is illustrated in FIG. 3. The measured signals 362 as well as the amplitude and timing of the transmitted signal 360 may be sent to the surface control unit 350 via lines 380-383. In certain embodiments, electromagnetic or acoustic signals with a pre-defined relationship may be transmitted from two detachable phases 301-304 and responses or reflections may be measured at the other detachable phases 301-304. The measured signals as well as the pre-defined phase relationship of the transmitted signals may be sent to the surface control unit 350 via lines 380-383. Other arrangements and methods would be appreciated by one of ordinary skill in the art in view of this disclosure.

In another embodiment, an electromagnetic and/or acoustic signal 390, may be transmitted from the earth's surface using a signal transmitter 392. The signal transmitter 392 may include a large current loop, a seismic source, or an electric field antenna comprised of a long wire connected to a ground potential at two separated points and driven with a source of current at a specified frequency. As described above, some or all of the detachable phases 301-304 may be configured to measure formation responses to or reflections of the signal 370. In yet other embodiments, the detachable phases 301-304 may measure seismic, acoustic, or electromagnetic signals that exist within the formation 370 without external excitation, such as the sound of fluid flowing within a well that is blowing out. The signals received by sensors 306-309 on the detachable phases 301-304 may be communicated to the surface via lines 380-383 and processed to develop an image of the formation 370 surrounding the detachable phases 301-304. In yet another embodiment, signals may be emitted from at least one of the detachable phases 301-304, and the signals may be received by arrays of sensors at the earth's surface.

Figure 4:
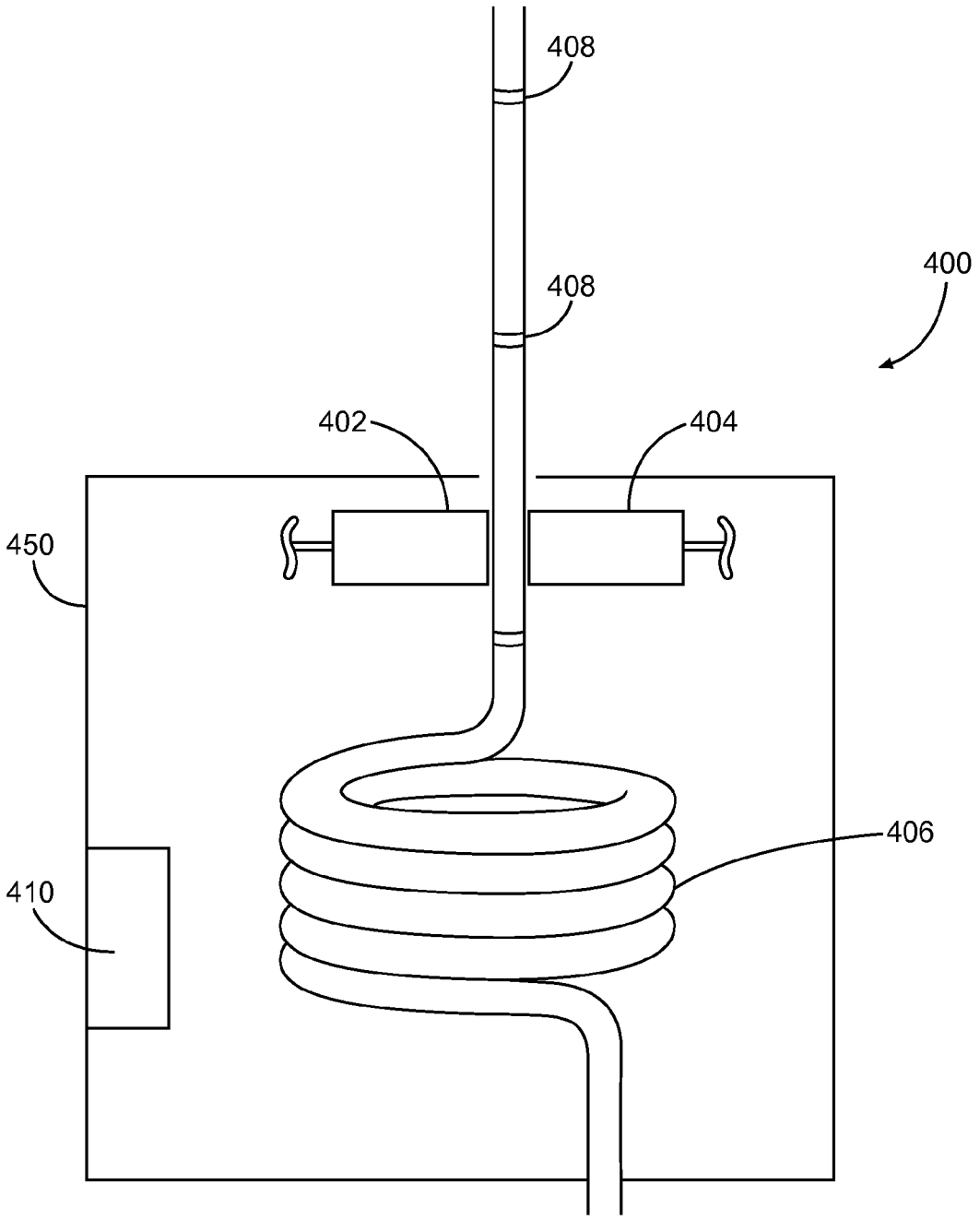
FIG. 4 is a diagram of an example line sensing assembly, according to aspects of the present disclosure.

As described above, at least some of the detachable phases may comprise line sensing assemblies that determine the length of line that has been paid out from a corresponding coil of line. FIG. 4 is a diagram of an example line sensing assembly 400, according to aspects of the present disclosure. The line sensing assembly 400 may comprise a light source 402, such as a light-emitting diode (LED), and a light detector 404, such as a photodiode. A coil of line 406 may comprise a plurality of marks 408 on an external surface. The plurality of marks 408 may comprise at least one of marks at pre-determined length intervals on the line or complex patterns, such as a periodic bar code, designating the location of the code on the line.

In use, the coil of line 406 may be illuminated by the light source 402 as it is paid out from the device phase 450, and the light may be received by the light detector 404. As each mark 408 passes by the light source 402, a change in light intensity may be identified at the light detector 404, which may signify that a mark 408 has passed. Where the marks 408 are at pre-determined length intervals, the number of marks 408 that have passed can be logged at a controller 410 communicably coupled to the light detector 404 and stored locally or transmitted to a surface controller through the line 403. The length of line that has been paid out can be determined by multiplying the number of marks 408 that have passed through the line sensing assembly 404 by the pre-determined length interval. In contrast, if the marks 408 are arranged as bar codes, the most recent bar code that passed by the light detector 404 may indicate the amount of line 406 that has been paid out.

Figure 5:
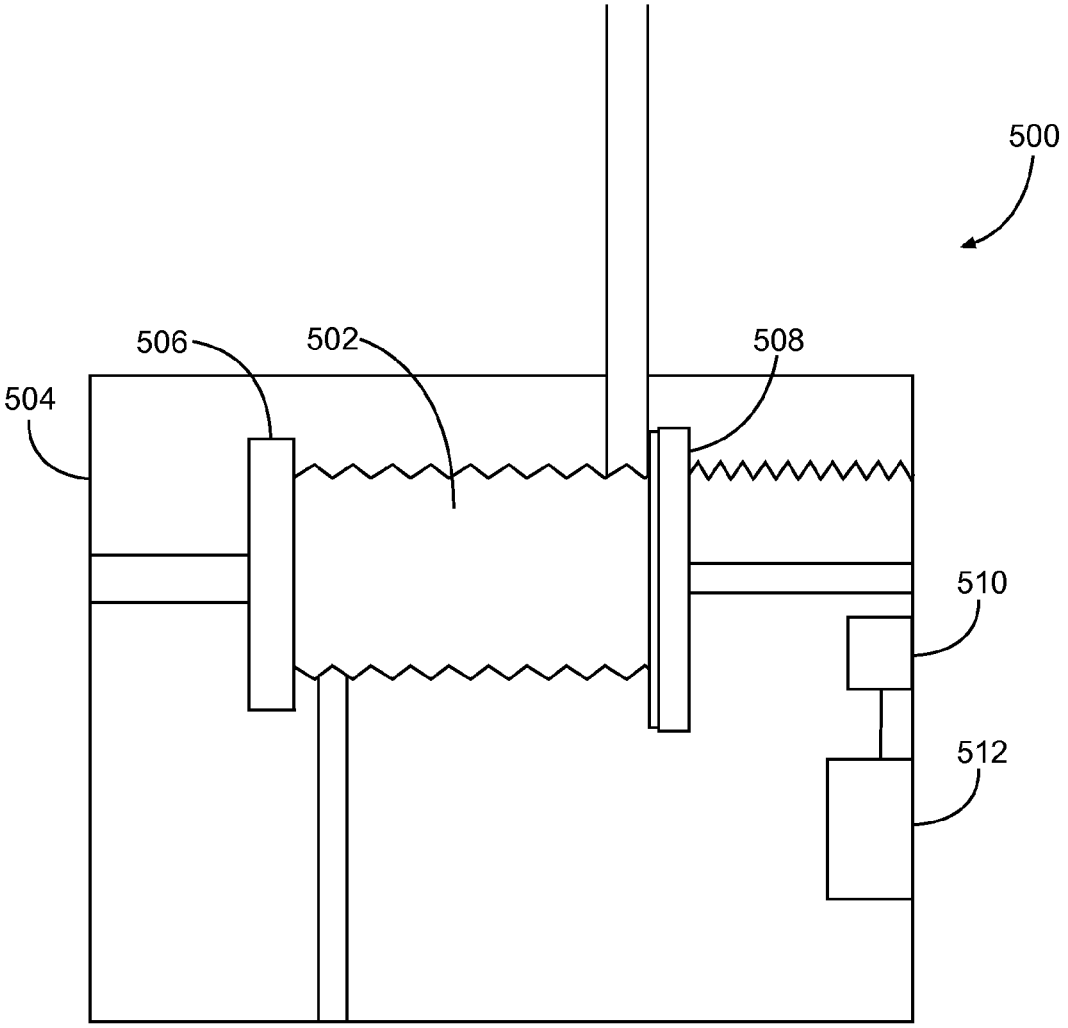
FIG. 5 is a diagram of an example line sensing assembly, according to aspects of the present disclosure.

FIG. 5 is a diagram of another example line sensing assembly 500, according to aspects of the present disclosure. In the embodiment shown, the coil of line 502 in a device phase 504 is arranged on a spool 506. The line sensing assembly 500 may comprise a spring loaded plate 508 adjacent one end of the spool 506. As the coil of line 502 is paid out, the distance from the plate 508 to a fixed location within the phase 504 may be determined periodically by pinging an acoustic signal off of the plate. In the embodiment shown, an acoustic sensor 510 may transmit an acoustic signal to the plate 508 and receive an echo from the plate 508. By measuring the time from the initiation of the ping to its reception at the sensor 510, the distance the plate has moved can be determined using the known speed of sound. Because the distance is proportional to a length of line that has been paid out, the length of line paid out may be calculated at a controller or processor 512 located within the device phase 504, or elsewhere.

According to aspects of the present disclosure, an example multi-phase drilling device may comprise a first phase with a first coil of line and a first sensor and a second phase releasably coupled to the first phase. The second phase may include a second coil of line and a second sensor. A drill bit may be coupled to the second phase. In certain embodiments, the first coil of line may have a plurality of marks on an external surface, and an optical assembly in the first phase may identify the presence of at least one of the marks to determine a length of the first coil of line has been spooled out. The plurality of marks include at least one of marks and bar codes positioned at pre-determined length intervals of the first coil of line. In certain embodiments, the first coil of line may be located on a spool within the first phase, a spring loaded plate may be adjacent to one end of the spool, and the location of the plate may be used to determine a length of line that has been spooled out.

In certain embodiments, the first sensor may comprise at least one of an acoustic sensor, an electric field sensor, and a magnetic field sensor. The first phase may further comprise at least one of an acoustic radiation source and an electromagnetic radiation source. The first phase, the second phase, and the drill bit may form a central bore. In certain embodiments, the first phase may further comprise at least one extendable anchor. The at least one extendable anchor may comprise at least one of an arm and a blade and may be extendable using at least one of a hydraulic pump and an electric motor. In certain embodiments, the first phase further may comprise a controller communicably coupled to at least one of the first sensor, the first coil of wire, and a releasable latch coupling the first phase to the second phase.

According to aspects of the present disclosure, an example method for distributed sensing in a subterranean formation may include drilling to a first depth in the subterranean formation using a drilling device and detaching a first phase of the drilling device at the first depth. The first phase may include a first coil of line and a first sensor. The drilling assembly may drill to a second depth and decouple a second phase of the drilling device, with the second phase including a second coil of line and a second sensor. Measurements may be generated at the first and second depths using the first and second sensors, respectively.

Drilling to the first depth in the subterranean formation using the drilling device may include determining the first depth based, at least in part, on a plurality of marks on an external surface of the first coil of line. The plurality of marks may comprise at least one of marks and bar codes positioned at pre-determined length intervals of the first coil of line. In certain embodiments, the first coil of line may be located on a spool within the first phase, and drilling to the first depth in the subterranean formation using the drilling device may comprise determining the first depth based, at least in part, on a spring loaded plate adjacent one end of the spool.

Generating measurements at the first depth using the first sensor may comprise generating measurements using at least one of an acoustic sensor, an electric field sensor, and a magnetic field sensor. In certain embodiments, generating measurements at the first depth using the first sensor may comprise generating at least one of acoustic radiation and electromagnetic radiation. In certain embodiments, the first phase and the second phase may form a central bore.

In certain embodiments, the method may further include anchoring the first phase at the first depth. Anchoring the first phase at the first depth may comprise extending at least one of an arm and a blade from the first phase using at least one of a hydraulic pump and an electric motor. In certain embodiments, the first phase further may comprise a controller communicably coupled to at least one of the first sensor, the first coil of wire, and a releasable latch coupling the first phase to the second phase.

In certain embodiments, the method may further include determining at least one characteristic of an object located within the subterranean formation based, at least in part, on the measured signal. This may include, for example, transmitting the measured signal to an information handling system located at the surface capable of processing the measured signals to determine the characteristic. In certain embodiments, determining at least one characteristic of the object located within the subterranean formation based, at least in part, on the measured signal comprises at least one of determining a location of a blow-out well within the formation; determining the location of a rock strata within the formation; determining the composition of a rock strata within a formation; and determining the presence of hydrocarbons within the formation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the elements that it introduces.

What is claimed is:

1. A multi-phase drilling device, comprising:

a first phase comprising a first coil of line and a first sensor;

a second phase releasably coupled to the first phase and comprising a second coil of line and a second sensor;

a drill bit coupled to the second phase; and wherein the first coil of line is located on a spool within the first phase.

2. The multi-phase drilling device of claim 1, wherein the first coil of line comprises a plurality of marks on an external surface; and the first phase further comprises an optical assembly to identify the presence of at least one of the marks.

3. The multi-phase drilling device of claim 2, wherein the plurality of marks comprises at least one of marks and barcodes positioned at pre-determined length intervals of the first coil of line.

4. The multi-phase drilling device of claim 1, wherein the first phase further comprises a spring loaded plate adjacent one end of the spool.

5. The multi-phase drilling assembly of claim 1, wherein the first sensor comprises at least one of an acoustic sensor, an electric field sensor, a magnetic field sensor, and an antenna.

6. The multi-phase drilling assembly of claim 5, wherein one of the first phase and the second phase further comprises a transmitter.

7. The multi-phase drilling assembly of claim 6, wherein the transmitter comprises at least one of a solenoid, a toroid, an electric field antenna, a piezoelectric stack, and a Terfonal-D stack.

8. The multi-phase drilling assembly of claim 1, wherein the first phase further comprises at least one extendable anchor.

9. The multi-phase drilling assembly of claim 8, wherein the at least one extendable anchor comprises at least one of an arm and a blade and is extendable using at least one of a hydraulic pump and an electric motor.

10. The multi-phase drilling assembly of claim 1, wherein the first phase further comprises a controller communicably coupled to at least one of the first sensor, the first coil of line, and a releasable latch coupling the first phase to the second phase.

11. A method for distributed sensing in a subterranean formation, drilling to a first depth in the subterranean formation using a drilling device;

detaching a first phase of the drilling device at the first depth;

drilling to a second depth in the subterranean formation using the drilling device;

detaching a second phase of the drilling device at the second depth;

measuring at least one of an electromagnetic, acoustic, and seismic signal with at least one of the first phase and the second phase; and spooling out a first coil of line within the first phase.

12. The method of claim 11, wherein drilling to the first depth in the subterranean formation using the drilling device comprises determining the first depth based, at least in part, on a plurality of marks on an external surface of a first coil of line.

13. The method of claim 12, wherein the plurality of marks comprises at least one of marks and bar codes positioned at pre-determined length intervals of the first coil of line.

14. The method of claim 11, wherein drilling to the first depth in the subterranean formation using the drilling device comprises determining the first depth based, at least in part, on a spring loaded plate adjacent one end of the spool.

15. The method of claim 11, wherein measuring at least one of the electromagnetic, acoustic, and seismic signal with at least one of the first phase and the second phase comprises measuring at least one of the electromagnetic, acoustic, and seismic signal with at least one of an acoustic sensor, an electric field sensor, a magnetic field sensor, and an antenna coupled to one of the first and second phases.

16. The method of claim 15, further comprising transmitting at least one of the electromagnetic, acoustic, and seismic signal from the other one of the first and second phases.

17. The method of claim 16, wherein transmitting at least one of the electromagnetic, acoustic, and seismic signal from the other one of the first and second phases comprises transmitting at least one of the electromagnetic, acoustic, and seismic signal from at least one of a solenoid, a toroid, an electric field antenna, a piezoelectric stack, and a Terfonal-D stack coupled to the other one of the first and second phases.

18. The method of claim 15, further comprising transmitting at least one of the electromagnetic, acoustic, and seismic signal from the surface of the subterranean formation.

19. The method of claim 11, further comprising determining at least one characteristic of an object located within the subterranean formation based, at least in part, on the measured signal.

20. The method of claim 19, wherein determining at least one characteristic of the object located within the subterranean formation based, at least in part, on the measured signal comprises at least one of determining a location of a blow-out well within the formation;

determining the location of a rock strata within the formation;

determining the composition of a rock strata within a formation; and determining the presence of hydrocarbons within the formation.

* * * * *